US008783487B2

(12) United States Patent
Hojo

(10) Patent No.: US 8,783,487 B2
(45) Date of Patent: Jul. 22, 2014

(54) SILICONE RESIN CONTAINER

(71) Applicant: Masaru Hojo, Tokyo (JP)

(72) Inventor: Masaru Hojo, Tokyo (JP)

( * ) Notice: Subject to any disclaimer, the term of this patent is extended or adjusted under 35 U.S.C. 154(b) by 0 days.

(21) Appl. No.: 13/729,999

(22) Filed: Dec. 28, 2012

(65) Prior Publication Data

US 2013/0256310 A1 Oct. 3, 2013

(30) Foreign Application Priority Data

Apr. 3, 2012 (JP) ..... 2012-84539

(51) Int. Cl.

| | |
|---|---|
| ***B65D 1/02*** | (2006.01) |
| ***B65D 21/08*** | (2006.01) |
| ***B65D 37/00*** | (2006.01) |
| ***B65D 1/40*** | (2006.01) |
| *B65D 33/16* | (2006.01) |
| *B65D 77/06* | (2006.01) |

(52) U.S. Cl.

CPC . *B65D 1/40* (2013.01); *B65D 33/16* (2013.01); *B65D 21/08* (2013.01); *B65D 77/06* (2013.01); *B65D 1/02* (2013.01); *B65D 1/0292* (2013.01); *Y10S 215/90* (2013.01)

USPC ..... 215/386; 215/900; 215/400; 215/396; 206/277; 220/666; 220/675; 220/623; 220/375; 220/6; 383/104; 383/80; 383/121; 222/90; 222/92; 222/94

(58) Field of Classification Search

CPC ..... B65D 1/02; B65D 21/08; B65D 90/12; B65D 79/005; B65D 35/56; B65D 35/04; B65D 77/06; B65D 7/06; B65D 33/06; B65D 33/00

USPC ..... 220/675, 666, 670, 623, 375, 6, 8, 720, 220/85, 530; 215/382, 386, 395, 900; 222/92, 95, 94; 141/338

See application file for complete search history.

(56) References Cited

U.S. PATENT DOCUMENTS

| | | | | | |
|---|---|---|---|---|---|
| 1,481,339 | A | * | 1/1924 | Barron | 222/107 |
| 1,825,897 | A | * | 10/1931 | Brooke | 294/31.2 |
| 2,147,349 | A | * | 2/1939 | Piquerez | 222/107 |
| 2,194,658 | A | * | 3/1940 | Hirst | 222/92 |
| 2,617,676 | A | * | 11/1952 | Kinney, Jr. | 294/31.2 |
| 2,970,729 | A | * | 2/1961 | Allen | 294/149 |
| 3,116,947 | A | * | 1/1964 | Brownrigg | 294/31.2 |
| 3,238,984 | A | * | 3/1966 | Shurtleff et al. | 383/95 |
| 3,299,442 | A | * | 1/1967 | White et al. | 604/322 |
| 3,353,714 | A | * | 11/1967 | Trecek | 222/107 |
| 3,395,836 | A | * | 8/1968 | Stahmer | 222/215 |

(Continued)

FOREIGN PATENT DOCUMENTS

| | | |
|---|---|---|
| JP | H06-312734 | 11/1994 |
| JP | 2010-275012 | 12/2010 |

*Primary Examiner* — Mickey Yu
*Assistant Examiner* — Gideon Weinerth
(74) *Attorney, Agent, or Firm* — Roylance, Abrams, Berdo and Goodman LLP

(57) ABSTRACT

A container made of silicone resin is sufficiently compactable in a collapsed state. The container includes a tubular barrel portion, a bottom portion having a flat surface, a mouth portion having an opening, and a lid portion sealing the opening of the mouth portion, with at least the barrel portion and the bottom portion formed by molding. One end of a binder is attached to the mouth portion and can hold the rolled-up barrel portion and the bottom portion.

6 Claims, 5 Drawing Sheets

(56) References Cited

U.S. PATENT DOCUMENTS

| | | | | | |
|---|---|---|---|---|---|
| 3,424,218 | A | | 1/1969 | Vanderbur et al. | |
| 3,638,834 | A | * | 2/1972 | Goodrich et al. | 222/105 |
| 3,682,352 | A | * | 8/1972 | Doucette | 220/754 |
| 3,727,803 | A | * | 4/1973 | Cobb | 222/215 |
| 3,926,341 | A | * | 12/1975 | Lhoest | 222/95 |
| 4,157,103 | A | * | 6/1979 | La Fleur | 141/98 |
| D257,426 | S | * | 10/1980 | D'Alo | D8/300 |
| 4,627,546 | A | * | 12/1986 | Carranza | 215/396 |
| 5,158,123 | A | * | 10/1992 | Senko | 141/338 |
| 5,174,458 | A | * | 12/1992 | Segati | 215/383 |
| 5,316,184 | A | * | 5/1994 | During | 222/107 |
| 5,373,965 | A | * | 12/1994 | Halm et al. | 222/92 |
| 5,484,083 | A | * | 1/1996 | Joulia | 222/107 |
| 5,562,221 | A | | 10/1996 | Beniacar | |
| 5,613,657 | A | * | 3/1997 | Olaiz | 248/102 |
| D403,958 | S | * | 1/1999 | Stepek | D9/434 |
| D413,800 | S | * | 9/1999 | Caparros et al. | D9/752 |
| 6,170,712 | B1 | * | 1/2001 | Kasboske | 222/215 |
| D474,682 | S | * | 5/2003 | Berman | D9/708 |
| 6,626,333 | B2 | * | 9/2003 | Levesque et al. | 224/148.6 |
| D507,629 | S | * | 7/2005 | Colligan | D23/213 |
| D512,910 | S | * | 12/2005 | Haslam | D9/434 |
| D535,562 | S | * | 1/2007 | Wisler et al. | D9/455 |
| D541,943 | S | * | 5/2007 | Stewart | D24/199 |
| D626,409 | S | * | 11/2010 | Hooley | D9/434 |
| 8,388,886 | B2 | * | 3/2013 | Wilkes | 264/523 |
| 2005/0061831 | A1 | * | 3/2005 | Brown et al. | 222/107 |
| 2006/0096987 | A1 | * | 5/2006 | Wry | 220/375 |
| 2006/0182372 | A1 | * | 8/2006 | Fadal et al. | 383/80 |
| 2008/0210697 | A1 | * | 9/2008 | Kessell et al. | 220/666 |
| 2008/0230545 | A1 | * | 9/2008 | Weene | 220/375 |
| 2009/0065505 | A1 | * | 3/2009 | Lai | 220/288 |
| 2009/0236341 | A1 | * | 9/2009 | McKinney et al. | 220/375 |
| 2009/0283047 | A1 | * | 11/2009 | Swenson et al. | 119/61.55 |
| 2010/0150478 | A1 | * | 6/2010 | Murray | 383/42 |
| 2011/0011874 | A1 | * | 1/2011 | Kurosawa | 220/665 |
| 2013/0075393 | A1 | * | 3/2013 | Haynie | 220/6 |

* cited by examiner

SILICONE RESIN CONTAINER

FIELD OF THE INVENTION

The present invention relates to a liquid container made of silicone resin, hereinafter written as a silicone resin container, and more specifically relates to silicone resin container that can be rolled up and maintained in a roll form.

BACKGROUND AND DESCRIPTION OF RELATED ART

Conventionally, containers made of synthetic resin that are compactly collapsible have been known.

Patent Document 1 (Japan Patent Pre-Publication No. H6-312734) discloses "a collapsible container made of synthetic resin including an integrally molded side wall portion and bottom wall portion and provided with a pair of side wall portion fold lines positioned on a plane passing through a container axis and a bottom wall portion fold line positioned on the plane, and where, at a connection portion of the side wall portion and the bottom wall portion, a pair of ground-contacting lower end edges are formed symmetrically with respect to the plane, the bottom wall portion fold line is made up of an apex or an apical side positioned slightly above the lower end edges and a pair of sides connecting the apex or apical side to the side wall portion fold line in a V-like shape or U-like shape, and fold lines are formed respectively between an end portion of the lower end edge and a side wall portion fold line-bottom wall portion fold line connection portion and between the end portion of the lower end edge and bottom wall portion apex or apical side."

However, with the art disclosed in Patent Document 1, folding or bending is difficult at portions besides portions of the "fold lines" provided at the side wall portion and the bottom wall portion and the container thus cannot be collapsed freely and its size reduction in the collapsed state is not sufficient. Also, collapsing must be performed at the priorly provided "fold line" portions and not only are time and effort thus required for a collapsing process but time and effort are also required for a process of restoration from the collapsed state to a state (usage state) enabling filling with a liquid, etc.

Patent Document 2 (Japan Patent Pre-Publication No. 2010-275012) discloses "a collapsible portable bottle in which an overlappingly folding portion is provided at a side surface of a barrel portion of a bottle, a collapsing portion is provided at an upper portion, a gusset portion is provided at a bottom, and a fastening portion is provided at an appropriate location of a main body of the bottle."

However, the art disclosed in Patent Document 2 has an arrangement that is collapsed by folding at the "overlappingly folding portion" or the "collapsing portion" provided at the side surface of the bottle barrel portion or the bottle upper portion, and as with Patent Document 1, the container cannot be folded freely and its size reduction in the folded state is not sufficient. Also, collapsing must be performed by folding at the priory provided "overlappingly folding portion" or "collapsing portion" and not only are time and effort thus required for a collapsing process but time and effort are also required for a process of restoration from the collapsed state to a state (usage state) enabling filling with a liquid, etc.

Patent documents are as set bellow.

[Patent Document 1] Japan Patent Pre-Publication No. H6-312734

[Patent Document 2] Japan Patent Pre-Publication No. 2010-275012

SUMMARY OF THE INVENTION

An object of the present invention is thus to provide a silicone resin container that can be made sufficiently compact in a collapsed state and with which a collapsing process and a process of restoration to a usage state can be performed readily and instantly.

The object of the present invention is achieved by the following means.

1. A silicone resin container including a tubular barrel portion, a bottom portion having a flat surface, a mouth portion having an opening, and a lid portion sealing the opening of the mouth portion, with at least the barrel portion and the bottom portion being formed of a silicone resin, and where at least the barrel portion and the bottom portion are formed by integral molding, one end of a binder is attached to the mouth portion, the barrel portion and the bottom portion are arranged to be capable of being rolled up in a roll form with the bottom portion as an axis and arranged so that the barrel portion and the bottom portion that have been rolled up in the roll form can be held in the rolled-up state by rolling tightly with the binder and attaching another end of the binder to the mouth portion.

2. The silicone resin container according to the above 1, where the bottom portion is provided with a groove portion.

3. The silicone resin container according to the above 1 or 2, where the groove portion is a rectilinear groove traversing from one end to another end of the bottom portion, extending to a side surface of a lower portion of the barrel portion, and passing through substantially a center of the bottom portion.

4. The silicone resin container according to any one of the above 1 to 3, where the binder is formed of a stretchable string-like body and attachment portions attachable to the mouth portion are provided at both ends.

5. The silicone resin container according to any one of the above 1 to 4, where the attachment portions are rings capable of being insertion-fitted onto the mouth portion.

6. The silicone resin container according to any one of the above 1 to 5, where the binder is formed of a silicone resin with a stretching property.

7. The silicone resin container according to any one of the above 1 to 6, where the mouth portion is provided with a protrusion.

8. The silicone resin container according to any one of the above 1 to 7, where the lid portion is provided with a packing made of a silicone resin.

Effects of the present invention are as follows.

With the invention according to the above 1, at least the barrel portion and the bottom portion are formed of the silicone resin, which is a soft material, and the barrel portion and the bottom portion can thus be collapsed by rolling into the roll form with the bottom portion as the axis and a sufficient size reduction can be achieved in a collapsed state. Also in the collapsed state, the barrel portion and the bottom portion can be rolled tightly by the binder having one end attached to the mouth portion, and the other end of the binder can be attached to the mouth portion in the tightly rolled state to readily maintain the collapsed state. Yet further, in the collapsed state, either end of the binder can be removed from the mouth portion to readily and instantly perform restoration, by a shape restorative force of the silicone resin forming the barrel portion and the bottom portion, to a state enabling filling with a liquid, etc., (also referred to hereinafter as the "usage state").

With the invention according to the above 2, by providing the bottom portion with the groove portion, the groove portion can be used as a guide for rolling up the bottom portion and the barrel portion and the bottom portion can thereby be rolled up accurately.

With the invention according to the above 3, by arranging the groove portion as the rectilinear groove traversing from one end to the other end of the bottom portion, extending to the side surface of the lower portion of the barrel portion, and passing through substantially the center of the bottom portion, the groove portion is made to serve as an axis during rolling of the barrel portion and the bottom portion to enable the barrel portion and the bottom portion to be rolled up more accurately.

With the invention according to the above 4, the binder is formed of the stretchable string-like body and thereby made capable of accommodating differences in size in the collapsed state due to roll-up conditions of the barrel portion and the bottom portion, and the attachment portions attachable to the mouth portion are provided at both ends to enable the collapsed state to be maintained readily by attachment of both ends to the mouth portion.

With the invention according to the above 5, the attachment portions are formed into ring shapes capable of being insertion-fitted onto the mouth portion and the ring-shaped attachment portions can thus be attached simply by fitting onto the mouth portion, thereby enabling a collapsing process as well as a process of restoration to a usage state to be performed readily and instantly.

With the invention according to the above 6, by adopting the silicone resin as the material of the binder, the binder is made to have a sufficient stretching property as well as excellent durability and heat resistance and can also be improved in aesthetic property because material of the same quality as that of the barrel portion and the bottom portion is adopted.

With the invention according to the above 7, the mouth portion is provided with the protrusion and thus when the attachment portions are attached to the mouth portion, the protrusion serves to prevent detachment of the attachment portions of the binder. Especially in the case where the attachment portions are formed into ring shapes, detachment of the attachment portions can be prevented by a simple structure.

With the invention according to the above 8, by adoption of the silicone resin as the packing of the lid portion, leakage of contents can be prevented and the packing can be made to have a durability and heat resistance equivalent to those of the barrel portion and the bottom portion.

DETAILED DESCRIPTION OF THE PRESENT INVENTION

A silicone resin container 1 according to the present invention is a container for mainly containing a beverage or other liquid and is a container that can be rolled up in a roll form and thereby collapsed compactly when an interior of the container is empty or extremely low in contents.

The present invention shall now be described in detail in accordance with the attached drawings.

Figure 1:
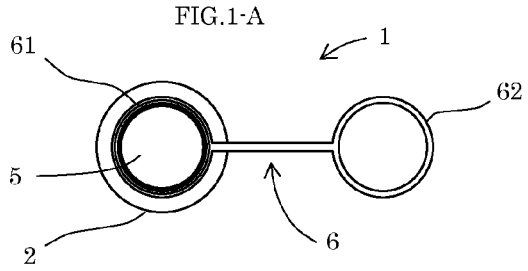
FIG. 1 shows an embodiment of silicone resin container of the present invention, wherein FIG. 1-A is plain view, FIG. 1-B left-side view, FIG. 1-C front view, FIG. 1-D bottom plain view.
Figure 1:
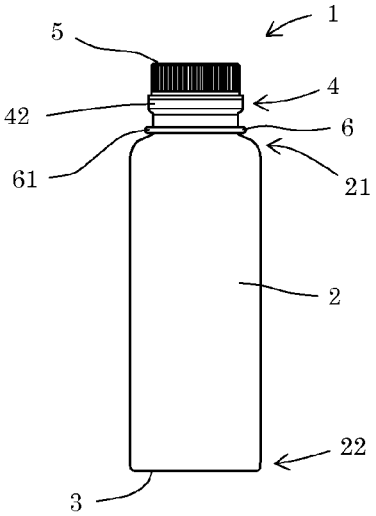
Figure 1:
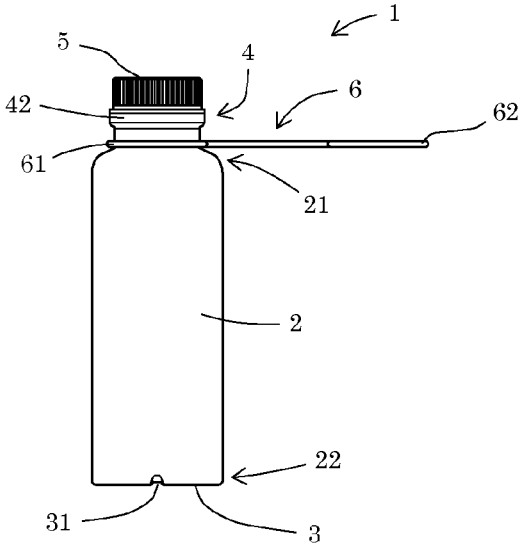
Figure 1:
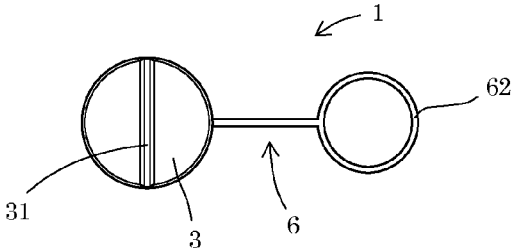

FIG. 1 shows six-side views of an embodiment of the silicone resin container 1 according to the present invention with a rear view being omitted due to appearing symmetrical to a front view and a right side view being omitted due to appearing symmetrical to a left side view.

Figure 2:
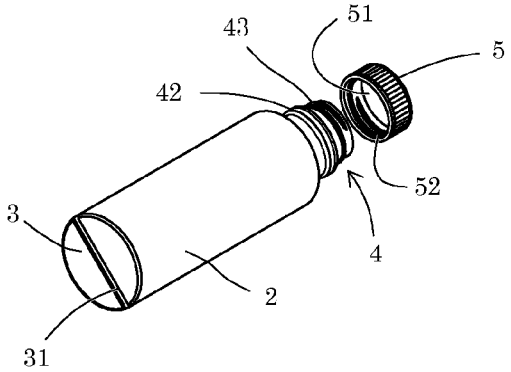
FIG. 2 shows an example of a container main body used in the first embodiment shown in FIG. 1, wherein FIG. 2-A is an isometric view, FIG. 2-B plain view, FIG. 2-C left-side view, FIG. 2-D front view, FIG. 2-E bottom plain view.
Figure 2:
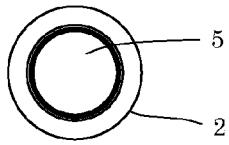
Figure 2:
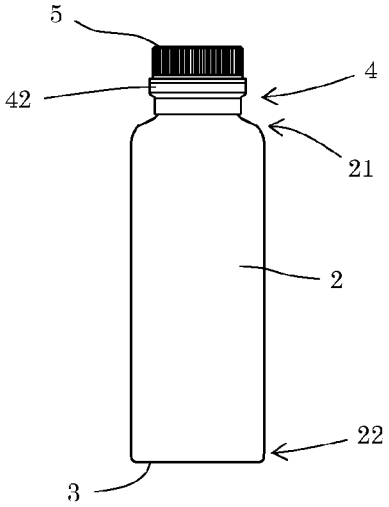
Figure 2:
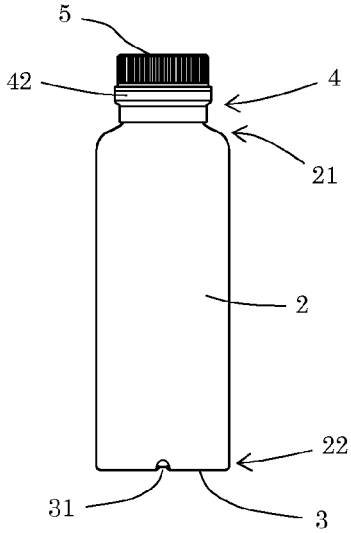
Figure 2:
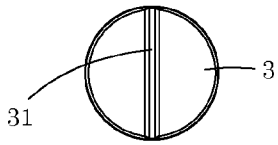

FIG. 2 shows six-side views of just a container main body, with which a binder 6 is removed from the silicone resin container 1 of FIG. 1, together with a perspective view of a state where a lid portion 5 is detached from a mouth portion 4. As with FIG. 1, a rear view is omitted due to appearing symmetrical to a front view and a right side view is omitted due to appearing symmetrical to a left side view.

As shown in FIG. 1, the silicone resin container 1 includes a barrel portion 2, a bottom portion 3, the mouth portion 4, and the lid portion 5, and has the binder 6 attached thereto.

The barrel portion 2 has a tubular shape and is positioned between the bottom portion 3 and the mouth portion 4. Although it is shown as having a cylindrical form in FIGS. 1 and 2, there is no restriction in the specific shape as long as the shape is tubular, and the shape may, for example, be a polygonal tube, such as a triangular tube or rectangular tube, etc.

The bottom portion 3 has a form with a flat surface for standing upright on a flat surface in a usage state and is positioned at a lower portion 22 of the barrel portion 2. Although shown as having a circular shape in bottom view in FIGS. 1 and 2, there is no restriction in shape as long as the form has a flat surface.

The bottom portion 3 may be provided with a groove portion 31. By providing the bottom portion 3 with the groove portion 31, the groove portion 31 can be used as a guide in a process of rolling up the bottom portion 3, thereby enabling the barrel portion 2 and the bottom portion 3 to be rolled up accurately.

The embodiment shown in FIGS. 1 and 2, as FIG. 1-D and FIG. 2-A and FIG. 2-E can be cited as a preferred embodiment of the groove portion 31. That is, the groove portion 31 is preferably a rectilinear groove traversing from one end to another end of the bottom portion 3, extending to a side surface of the lower portion 22 of the barrel portion 2, and passing through substantially a center of the bottom portion 3. This groove portion 31 serves as an axis in the process of rolling up the barrel portion 2 and the bottom portion 3 so that a center of the bottom portion 3 can be used as the axis to roll up the barrel portion 2 and the bottom portion 3 more accurately.

The barrel portion 2 and the bottom portion 3 are formed by integral molding using a silicone resin as a material.

As the silicone resin used as the material, a publicly known and used silicone resin having flexibility, durability, and heat resistance and used in eating utensils or cooking utensils may be adopted without any special restrictions. Also, a silicone resin having a definite shape retention such that even when the barrel portion 2 or the bottom portion 3 is folded or rolled, the usage state is restored immediately upon release of restriction, such as binding, etc., by the binder 6, etc., is preferable.

A thickness of a side wall of the barrel portion 2 is preferably in a range of 1 mm to 3 mm and more preferably in a range of 1.2 mm to 1.8 mm. Also, a thickness of the bottom portion 3 (which refers to a thickness of a portion besides the groove portion 31) is preferably in a range of 1.5 mm to 4.5 mm and more preferably in a range of 1.8 mm to 3.0 mm. Yet further, in comparing the thickness of the side wall of the barrel portion 2 and the thickness of the bottom portion 3, the bottom portion 3 is preferably formed to be slightly thicker so that its thickness is approximately 1.2 to 1.6 times the thickness of the side wall of the barrel portion 2. The bottom portion 3 is formed so that its thickness is slightly thicker than the thickness of the side wall of the barrel portion 2 because a force of restoration from a collapsed state to the usage state is excellent and the container stands upright readily in the usage state.

The mouth portion 4 has an opening 41 and is positioned at an upper portion 21 of the barrel portion 2.

The opening 41 is provided for pouring a beverage or other liquid into and out of the silicone resin container 1 and there are no restrictions in its shape.

The mouth portion 4 may be provided with a protrusion 42. The protrusion serves a role of a retainer when an attachment portion 62 of the binder 6, to be described below, is attached to the mouth portion 4. The protrusion 42 is thus provided at a circumference of the mouth portion 4 and projects further outward than a circumferential wall that forms the mouth portion 4. Although there is no restriction in the mode of the protrusion 42, a mode where it is provided across the entire circumference at a substantially central portion in a vertical direction of the mouth portion as shown in FIG. 1-B of FIG. 1 and FIG. 2-C of FIG. 2 can be cited as an example. Also, the protrusion does not have to be provided continuously across the entire circumference and may be provided intermittently across the entire circumference, or one or no less than two protrusions 41 may be provided at a portion of the circumference of the mouth portion 4 (neither case is illustrated). The protrusion 42 is especially effective in a case where the attachment portion 62 is formed into a ring shape because detachment of the attachment portion 62 can then be prevented by a simple structure.

The opening 41 is sealed by coupling the lid portion 5, to be described below, to the mouth portion 4. Although the means for coupling the mouth portion 4 and the lid portion 5 together is not restricted, in a case where a threaded engagement is adopted as a coupling means, a mouth-side thread portion 43 is formed at the mouth portion 4.

The lid portion 5 is provided for sealing the opening 41 of the mouth portion 4. It can prevent spilling or leakage of a beverage or other liquid that has been poured into the silicone resin container.

Preferably, the lid portion 5 is provided with a packing 51 and the packing 51 is made of a silicone resin. Leakage of the contents can thereby be prevented, and handling is easy because the packing 51 has a durability and heat resistance equivalent to the barrel portion 2 and the bottom portion 3 and can thus be handled in common in regard to use in a dishwasher, ability to perform hot water sterilization, etc.

The means for coupling the lid portion 5 and the mouth portion 4 together is not restricted, and in a case where a threaded engagement is adopted as the coupling means as shown in FIG. 2-A of FIG. 2, a lid-side thread portion 52 corresponding to the mouth-side thread portion 43 is formed on the lid portion 5.

Also, although the lid portion 5 and the mouth portion 4 are shown as separate entities in FIG. 2, the present invention is not restricted to this arrangement, and arts that are publicly known and used as lids of beverage containers may be adopted without any special restriction. For example, an arrangement where the lid portion 5 and the mouth portion 4 are coupled together by a hinge and enabled to open/close may be adopted, or a threaded engagement arrangement where the lid portion 5 is positioned at the inner side and the mouth portion 4 is positioned at the outer side in a manner opposite that of the arrangement of the figure may be adopted, or an arrangement may be adopted where, from a state where the lid portion 5 is fixed to the mouth portion 4, the lid portion 5 is opened/closed by a knock-type arrangement or other publicly known arrangements such that the opening 41 can be opened/closed without detaching the lid portion 5 from the mouth portion 4.

Although the material for forming the mouth portion 4 and the lid portion 5 is not restricted, it is preferably a hard material that is not a soft material, such as a silicone resin, etc. This is because if the mouth portion 4 or the lid portion 5 is soft, the contents may leak out due to deformation. As an example of a material for forming the mouth portion 4 and the lid portion 5, polypropylene, etc., can be cited. Also, the mouth portion 4 and the lid portion 5 may be formed of different materials.

The binder 6 is for maintaining the collapsed state when the barrel portion 2 and the bottom portion 3 have been rolled up in the roll form.

Figure 3:
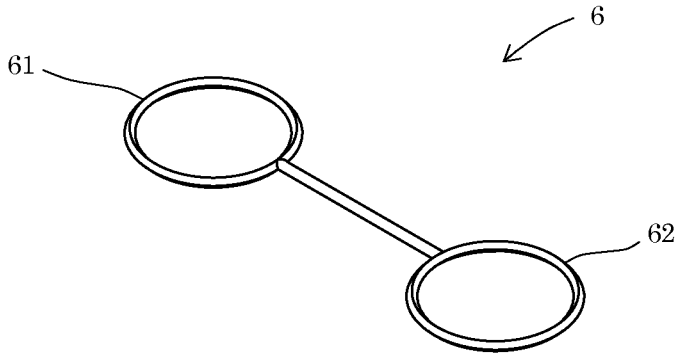
FIG. 3 shows an example of a binder used in the first embodiment shown in FIG. 1.

In FIG. 3, an embodiment of the binder 6 is shown as isometric view.

The form of the binder 6 is not restricted in particular as long as it is of a mode with which both ends are attached to the mouth portion 4 and the barrel portion 2 and the bottom portion 3 that have been rolled up can be rolled tightly.

As a form of the binding portion 6, a string-like body of a form with attachment portions 61 and 62, attachable to the mouth portion 4, being provided at both ends and the attachment portions 61 and 62 having ring shapes enabling insertion-fitting onto the mouth portion 4 as shown in FIG. 3 can be cited.

Besides the above, a mode where a latching portion is provided at the mouth portion 4 and the forms of the attachment portions 61 and 62 are made forms corresponding to the latching portion at the mouth portion 4 and are made to be attached by latching, or a mode where the attachment portions 61 and 62 take the forms of buttons or a hook-and-loop fastener, etc., can be cited (not illustrated). Also, with the attachment portions 61 and 62, the attachment portion 61 at one end and the attachment portion 62 at the other end may have different forms.

Preferably all or a portion of the material forming the binder 6 has stretchability. This is because by making the binder 6 stretchable, differences in size in the collapsed state due to conditions of roll-up of the barrel portion 2 and the bottom portion 3 can be accommodated.

Further, a stretchable or elastic silicone resin is more preferably adopted as the material for forming the binder 6. The binder 6 will then have a durability and heat resistance equivalent to the barrel portion 2 and the bottom portion 3 and is made easy to handle because it can be handled in common in regard to use in a dishwasher, ability to perform hot water sterilization, etc., and can also be improved in aesthetic property.

A roll-up means (collapsing means) of the silicone resin container 1 according to the present invention shall now be described in accordance with FIG. 4.

Figure 4:
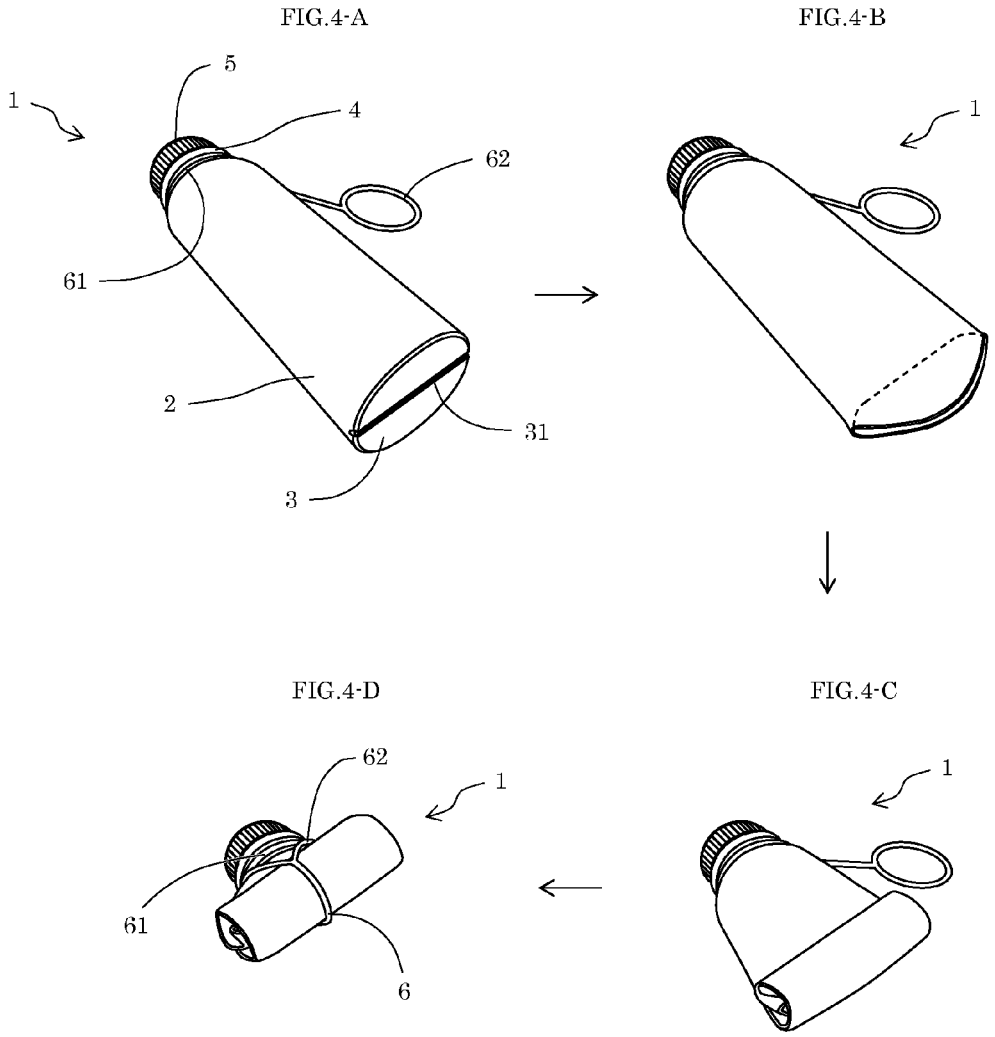
FIG. 4 shows explanatory diagrams of a process of transition from a usage state to a collapsed state.

FIG. 4-A of FIG. 4 is a diagram showing a usage state (state enabling filling with a liquid, etc.). Although in the figure, the attachment portion 61 at one end of the binder 6 is attached to the mouth portion 4, the binder 6 does not have to be attached to the mouth portion 4 in the usage state.

First, as shown in FIG. 4-B of FIG. 4, the bottom portion 3 is folded in half. Although an inward fold is performed in the figure, the fold may be an outward fold instead. Also, in the case of the embodiment with the groove portion 31 formed at the bottom portion 3, the bottom portion 3 is folded along the groove portion 31. Although in the figure, the lid portion 5 is attached to the mouth portion 4 in this process, it is preferable for the lid portion 5 to be loosened or removed. This is because in the state where the lid portion 5 is attached, the container is high in sealing property and deformation of the bottom portion 3, etc., is difficult because air inside the container is not vented.

Thereafter as shown in FIG. 4-C of FIG. 4, the barrel portion 2 is rolled up in a roll form with the folded bottom portion 3 as an axis. As in FIG. 4-B, the lid portion 5 is preferably loosened or removed in this process.

Lastly, as shown in FIG. 4-D, the barrel portion 2 and the bottom portion 3 are rolled up to a degree of reaching the mouth portion 4 and the rolled-up barrel portion 2 and bottom portion 3 are rolled tightly with the binder 6. In this process, the rolled-up barrel portion 2 and bottom portion 3 are rolled tightly upon attaching the attachment element 61 at one end of the binder 6 to the mouth portion 4 and then the attachment portion 62 at the other end is attached to the mouth portion 4. The barrel portion 2 and the bottom portion 3 are thereby maintained in the rolled-up state (collapsed state). In FIG. 4-D the attachment portions 61 and 62 have ring shapes, and thus by fitting the attachment portion 61 at one end onto the mouth portion 4 from above, fittingly attaching it or movably fitting it below the protrusion 42, then tightly rolling the rolled-up barrel portion 2 and bottom portion 3 with the string-like portion of the binder 6, fitting the attachment portion 62 at the other end onto the mouth portion 3 from above, and then fittingly attaching it or movably fitting it below the protrusion 42, the binder 6 is fixed to the mouth portion 4 and the collapsed state is maintained.

To restore the silicone resin container 1 according to the present invention from the collapsed state to the usage state, the attachment portion 61 or 62 at either end of the binder 6 attached to the mouth portion 4 is simply detached from the mouth portion 4 and the lid portion 5 is loosened or removed. The barrel portion 2 and the bottom portion 3 are thereby restored to the shape of the usage state by a restorative force that the silicone resin has. The lid portion 5 is loosened or removed to release the sealed state of the container and put air inside the container.

An example of a means for coupling the barrel portion 2 and the mouth portion 4 together shall now be described in accordance with FIG. 5.

Figure 5:
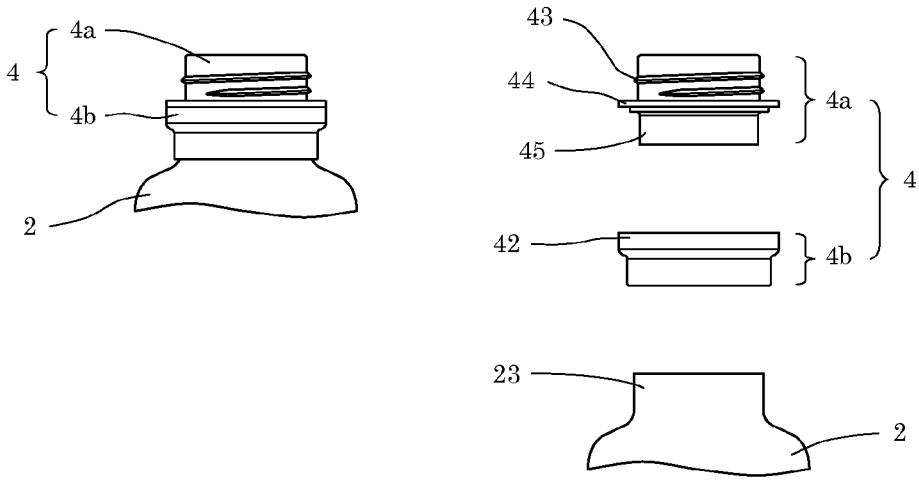
FIG. 5 shows exploded explanatory diagrams of a portion of a barrel portion and a mouth portion.
Figure 5:
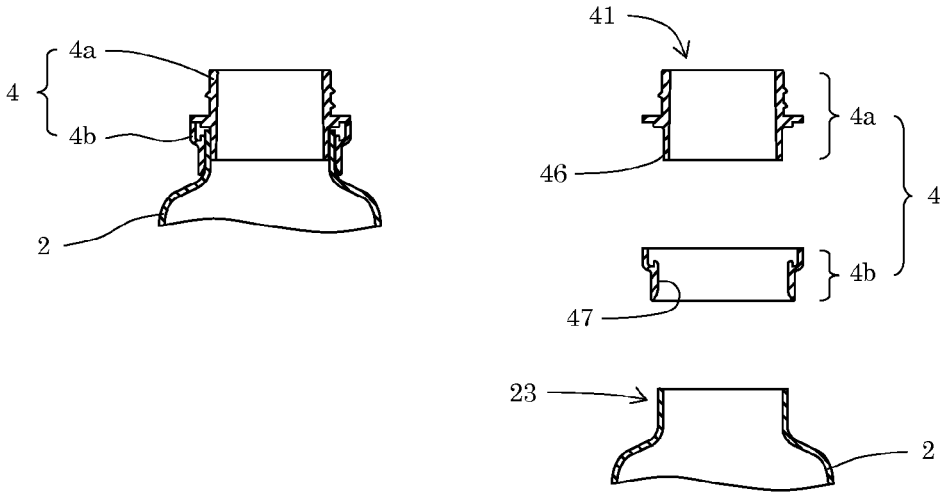

FIG. 5-A is an exploded explanatory diagram of a portion of the upper portion 21 of the barrel portion 2 and the mouth portion 4, and FIG. 5-B is a sectional view thereof.

As shown in FIGS. 5-A and 5-B, the mouth portion 4 may be arranged from the two members of an inner member 4*a* and an outer member 4*b*. The arrangement made up of two members is one example of the arrangement of the mouth portion 4 and the present invention is not restricted to this arrangement.

The inner member 4*a* includes the opening 41 and the mouth-side thread portion 43, is formed into a tubular form, has a collar portion 44 provided below the mouth-side thread portion 43, and has an inner tubular portion 45 provided therebelow, and an outer wall of the inner tubular portion 45 is referred to as an outer wall portion 46.

The outer member 4*b* includes the protrusion 42, is formed into a tubular form, and an inner wall thereof is referred to as an inner wall portion 47.

The collar portion 44 of the inner member 4*a* and the protrusion 42 of the outer member 4*b* are formed to substantially the same diameter and are coupled together to form an integral protrusion.

As shown in FIG. 5-B, the barrel portion 2 and the mouth portion 4 are coupled together by sandwichingly or fittingly attaching an enclosed portion 23, positioned at an upper end of the upper portion 21 of the mouth portion 2, by the inner member 4*a* and the outer member 4*b*. To be more detailed, the enclosed portion 23 is sandwiched between the outer wall portion 46 of the inner tubular portion 45 of the inner member 4*a* and the inner wall portion 47 of the outer member 4*b* and thereby attached sandwichingly or fittingly. The collar portion 44 and the protrusion 42 are also coupled together in this process. The inner member 4*a*, the outer member 4*b*, and the enclosed portion 23 of the barrel portion may be coupled together just by the sandwiching or fitting attachment or may be welded together by application of high-frequency waves, or further, an adhesive agent, etc., may be used, or two or more of the above methods may be combined.

Usage examples of the silicone resin container 1 according to the present invention shall now be described.

As mentioned above, the silicone resin container 1 can be used as a container in which a beverage or other liquid can be contained, can be collapsed compactly by rolling up into a roll form when the container interior is empty or extremely low in contents, and is a container that is convenient to carry around. The container has heat resistance from low temperature to high temperature due to being made of the silicone resin and can be used in a microwave oven or placed in a freezer.

For example, by attaching an artificial nipple to the mouth portion 2, the container can be used as a baby bottle that is convenient to carry around. When going out, the silicone resin container 1 can be carried around in the collapsed state and in giving milk, etc., to an infant, the container can be used as the baby bottle by putting it in the usage state, attaching the artificial nipple, and putting in and mixing together powdered milk and warm water. In this case, it is convenient to form the nipple from the silicone resin because it can then be handled in the same manner as the silicone resin container 1.

Use, for example, as a container for refilling with a beverage is also possible. Although recently, the bringing-in of PET bottles and paper cups in entering a stadium for watching sports, etc., has become prohibited in many cases, a visitor can bring the silicone resin container 1 and refill it with a purchased beverage etc., upon entry to bring the beverage into the stadium, or a sponsor may make available the silicone containers 1, distribute it among the visitors, and encourage the visitors to refill the containers with a beverage. In this case, the sponsor may adopt a system where the silicone resin container 1 is loaned out to the visitors, a deposit is received from each visitor, and the deposit is repaid to each visitor in exchange for returning the silicone resin container 1 while existing.

DESCRIPTION OF THE REFERENCE NUMERALS

1 Silicone resin container
2 Barrel portion
21 Upper portion
22 Lower portion

23 Enclosed portion
3 Bottom portion
31 Groove portion
4 Mouth portion
4*a* Inner member
4*b* Outer member
41 Opening
42 Protrusion
43 Mouth-side thread portion
44 Collar portion
45 Inner tubular portion
46 Outer wall portion of inner tubular portion
47 Inner wall portion of outer tubular portion
5 Lid portion
51 Packing
52 Lid-side thread portion
6 Binder
61, 62 Attachment portion

What is claimed is:

1. A silicone resin container, comprising:

a tubular barrel portion of a silicone resin having first and second ends;

a bottom portion having a flat surface at said first end and being integrally molded with said barrel portion of silicone resin, said barrel portion and said bottom portion being rollable into a rolled-up state with said bottom portion forming a roll axis;

a mouth portion having an opening at said second end of said barrel portion; and a binder of a stretchable string-shaped body having an elongated portion and first and second attachment rings at opposite ends of said elongated portion, said first attachment ring being mounted on said mouth portion, said second attachment ring being mountable on said mouth portion in the rolled-up state with said elongated portion of said body extending around said barrel portion and said bottom portion to maintain said barrel portion and said bottom portion in the rolled-up state.

2. A silicone resin container according to claim 1 wherein said bottom portion comprises a groove portion.

3. A silicone resin container according to claim 2 wherein said groove portion comprises a rectilinear groove traversing from one edge to an opposite edge of said bottom portion, extending to a side surface of a lower portion of said barrel portion and passing through substantially a center of said bottom portion.

4. A silicone resin container according to claim 1 wherein said binder is formed of a stretchable silicone resin.

5. A silicone resin container according to claim 1 wherein said mouth portion comprises a protrusion.

6. A silicone resin container according to claim 1 wherein a lid portion is mounted on said mouth portion and has a gasket of silicone resin.

* * * * *